US008534322B2

(12) United States Patent
Hoppe et al.

(10) Patent No.: US 8,534,322 B2
(45) Date of Patent: Sep. 17, 2013

(54) HYDRAULIC DIRECTIONAL VALVE

(75) Inventors: Jens Hoppe, Erlangen (DE); Stefan Konias, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 85 days.

(21) Appl. No.: 13/132,345

(22) PCT Filed: Nov. 13, 2009

(86) PCT No.: PCT/EP2009/065156

§ 371 (c)(1),
(2), (4) Date: Jun. 2, 2011

(87) PCT Pub. No.: WO2010/063556

PCT Pub. Date: Jun. 10, 2010

(65) Prior Publication Data

US 2011/0232781 A1 Sep. 29, 2011

(30) Foreign Application Priority Data

Dec. 2, 2008 (DE) ..... 10 2008 060 069

(51) Int. Cl.
*F16K 11/07* (2006.01)

(52) U.S. Cl.
USPC ..... 137/625.65; 137/545

(58) Field of Classification Search
USPC ..... 137/544, 545, 625.26, 625.65
See application file for complete search history.

(56) References Cited

U.S. PATENT DOCUMENTS

| | | | | |
|---|---|---|---|---|
| 3,741,523 | A * | 6/1973 | Scaramucci et al. | 251/315.13 |
| 5,169,524 | A * | 12/1992 | Meiritz et al. | 210/232 |
| 5,482,622 | A * | 1/1996 | Stark et al. | 210/232 |
| 6,848,404 | B2 * | 2/2005 | Maeyama et al. | 123/90.17 |
| 2003/0226593 | A1 | 12/2003 | Okada | |
| 2006/0021933 | A1 * | 2/2006 | Radcliffe | 210/483 |
| 2008/0217895 | A1 * | 9/2008 | Hayakawa et al. | 280/741 |

FOREIGN PATENT DOCUMENTS

| | | | |
|---|---|---|---|
| CN | 1576612 | A | 2/2005 |
| DE | 100 27 080 | A1 | 3/2001 |
| DE | 10 2004 031 996 | A1 | 2/2005 |
| JP | 2004011742 | A | 1/2004 |
| JP | 2006 022816 | A | 1/2006 |
| JP | 2007232127 | A | 9/2007 |
| WO | 2008/034879 | A1 | 3/2008 |

* cited by examiner

*Primary Examiner* — Craig Schneider
*Assistant Examiner* — Angelisa Hicks
(74) *Attorney, Agent, or Firm* — Lucas & Mercanti, LLP

(57) ABSTRACT

A hydraulic directional valve which has a valve housing and a filter element. At least one groove encircles the valve housing and the filter element is arranged in the groove and has at least one frame element and a filter fabric which is firmly connected to the frame element. The groove has a groove base and two side walls which extend substantially in the radial direction and circumferential direction.

10 Claims, 2 Drawing Sheets

HYDRAULIC DIRECTIONAL VALVE

This application is a 371 of PCT/EP2009065156 filed Nov. 13, 2009, which in turn claims the priority of DE 10 2008 060 069.5 filed Dec. 2, 2008, the priority of both applications is hereby claimed and both applications are incorporated by reference herein.

FIELD OF THE INVENTION

The invention relates to valves and more particularly to a hydraulic directional valve.

BACKGROUND OF THE INVENTION

Directional valves of this type are used in internal combustion engines, for example for actuating hydraulic camshaft adjusters or switchable cam followers, for example switchable drag levers, bucket tappets or roller tappets. The directional valves comprise an actuating unit and a valve section. The actuating unit can be, for example, an electromagnetic or hydraulic actuating unit. The valve section represents the hydraulic section of the directional valve, a feed connection, at least one working connection and a tank connection usually being configured on said section. Defined connections of the valve section can be hydraulically connected to one another in a targeted manner by means of the actuating unit and therefore the pressure medium flows can be directed.

For the use of a directional valve for controlling a camshaft adjuster, said directional valve is configured in the normal case as a 4/3-way proportional valve. A proportional valve of this type is disclosed, for example, in DE 100 27 080 A1.

The valve section comprises a valve housing and a control piston which is arranged such that it can be displaced axially in said valve housing. The valve housing is usually arranged within a cylindrical, blind bore-like receptacle of the cylinder head or a central hole of the camshaft adjuster. Four annular grooves are formed on the outer circumferential face of the valve housing, in the groove bottoms of which annular grooves openings are formed which serve as pressure medium connections. One pressure medium channel which opens into the respective annular groove is formed per annular groove in the cylinder head. Pressure medium can pass into the interior of the valve housing or can escape from the interior of the valve housing via the connections. A control piston is arranged axially displaceably in the interior of the valve housing, the external diameter of the control piston being adapted to the internal diameter of the valve housing. Furthermore, annular grooves are likewise formed on the control piston, via which annular grooves adjacent pressure medium connections can be connected to one another.

A coil and an armature are arranged in the interior of the actuating unit. The armature is displaced in the axial direction by applying current to the coil, this movement being transmitted to the control piston by means of a push rod which is fastened to the armature. Furthermore, a spring acts on the control piston, which spring is supported on the valve housing and loads the piston with a force in the axial direction toward the actuating unit.

Directional valves for actuating switchable cam followers are usually configured as control valves. A control valve of this type is known, for example, from DE 103 59 363 A1, in an embodiment as a 3/2-way control valve. The function and the configuration of the electromagnetic actuating unit are largely analogous to those of the proportional valve.

In this case, a feed connection, a working connection and a tank connection are configured on the valve section. The working connection communicates both with the feed connection and with the tank connection via in each case one opening which is configured as a valve seat. Furthermore, a control piston is arranged within the valve housing, on which control piston two closing elements are formed. Depending on the position of the control piston within the valve housing, each closing element can shut off or release the pressure medium flow through one of the valve seats. Depending on the axial position of the control piston, the working connection can thus be connected selectively to the feed connection or to the tank connection. Here, the axial position of the control piston is in turn fixed via the axial position of the armature relative to the second magnet yoke.

In DE 100 27 080 A1, each of the hydraulic connections is assigned an annular filter. Each annular filter is positioned in one of the annular grooves, each annular filter extending along the entire circumferential direction of the circular groove bottom. The annular filter has a frame element made from an elastic plastic. The frame element has two part elements which extend in the circumferential direction of the valve housing, lie opposite one another in the axial direction and are connected to one another via transverse struts. A filter fabric is arranged between the part elements and the transverse struts. For example, the filter fabric can be inserted into the injection mold as a molded part during the production of the frame element and can be encapsulated with the plastic by injection molding. The frame element is of elastic configuration and, in the circumferential direction, has two open ends which lie opposite one another and can be connected to one another by means of a closure after the insertion of the annular filter into the groove.

It is disadvantage of this embodiment that in the case of a slight faulty orientation of the annular filter with respect to the valve housing, the transverse struts of the frame element can be arranged radially with respect to the openings of the connections or directly adjacently to the opening of the pressure medium channel which is formed in the cylinder head and with which the annular groove communicates. The faulty orientation can be caused during operation, for example, by the flow forces of the pressure medium and the play between the annular groove and the frame element. This results in considerable throttling of the pressure medium flow through the directional valve, which leads to an undesired, temporally variable change in the directional valve characteristics, and therefore in the worst case to the failure of the controller of the connected hydraulic consumer.

SUMMARY OF THE INVENTION

The present invention relates to a hydraulic directional valve which has a valve housing and a filter element. At least one groove extends in a circumferential direction is provided on the valve housing. The filter element is arranged in the groove and has at least one frame element and a filter fabric which is connected fixedly to said frame element, and the groove having a groove bottom and two side walls which extend substantially in the radial direction and circumferential direction, and to a method for producing the directional valve.

The invention is therefore based on the object of avoiding these depicted disadvantages and therefore providing a hydraulic directional valve which has at least one filter element for protecting one of the hydraulic connections from contaminants of the pressure medium; it is intended that the provided valve characteristic is to be maintained over the entire service life of the internal combustion engine.

According to the invention, the object is achieved by the fact that at least one of the side walls has at least one axial bulge which extends in the direction of the frame element and acts on the frame element in a positive and/or nonpositive manner.

The, for example, cylindrical valve housing of the hydraulic directional valve has a groove which extends in the circumferential direction of the valve housing and is configured, for example, as an annular groove. The groove has a groove bottom, in which radial openings are formed, via which the groove communicates with the interior of the valve housing. The groove therefore acts as a hydraulic connection, via which pressure medium can pass into the interior of the valve housing or can escape out of it. The filter element which can be configured, for example, as an annular filter is arranged within the groove. The filter element has a filter fabric which is delimited by a frame element which is produced, for example, from a suitable plastic. In the case of an annular filter, the frame element has two circular part elements which are arranged axially with respect to one another and are connected to one another via axial struts. Here, the dimensions of the frame element are adapted to the dimensions of the groove in such a way that pressure medium which is fed to the interior of the valve housing or is discharged from it has to pass through the filter fabric. This ensures that contaminants of the pressure medium do not pass into the interior of the valve housing. The groove is formed to be open radially to the outside and is delimited radially to the inside by a groove bottom which is shaped like a cylinder shell, for example, and is delimited in the axial direction by in each case one side wall which is annular, for example. An axial bulge which extends toward the frame element is formed on at least one of the side walls. The filter element is secured by means of the bulge against movements in the circumferential direction of the valve housing. This can be realized by a positive connection and/or nonpositive connection between the bulge and the frame element. The bulge can be formed, for example, only in a defined region of the side wall. As an alternative, the bulge can be formed, for example, along the entire extent of the groove in the circumferential direction. This prevents the filter element from being displaced undesirably out if its installation position in the case of pressure medium through-flow.

There can be provision here for the bulge to bear nonpositively against an axial side face of the frame element. In this case, the filter element bears with axial prestress against the bulge. This can be realized by the fact that, after the insertion of the filter element into the groove, material of the side wall is displaced in the axial direction, for example by means of a calking operation. In this case, the frame element is clamped in between the bulge and the side wall which lies opposite. The frame element advantageously protrudes beyond the groove in the radial direction. This ensures that the axially extending bulge acts on the axial side face of the frame element.

There can be provision in one alternative embodiment for the bulge to be arranged at least partially radially outside the frame element and to bear nonpositively against a radially outer face, for example the circumferential face, of the frame element. In this case, the filter element is pressed radially to the inside against the groove bottom.

There can be provision in a further alternative embodiment for the bulge to engage into a depression, for example a cutout, of the frame element. In this case, cutouts, into which material of the side wall is displaced, can be provided on the frame element, for example in an axial or radial side face. As an alternative, the material of the bulge can bury itself into the frame element during its production. The depressions of the frame element and the bulge of the side wall therefore act as a stop and a corresponding stop, as a result of which a movement of the filter element relative to the bulge and therefore the groove bottom is prevented. In addition, in this embodiment, the bulge can act nonpositively on the bounding walls of the cutout. Relative movements between the filter element and the bulge are therefore suppressed effectively.

There is provision in one specific embodiment of the invention for at least the side wall which is provided with the bulge to be of stepped configuration, the frame element (at least partially) and the bulge being arranged radially within the step. In this case, after the insertion of the filter element into the groove, the calking tool can act on the step, in order to form the bulge. Material of the step which is displaced radially to the outside during the calking operation is therefore still situated radially within the groove. This prevents a radial projection being produced on the valve housing, by way of which radial projection mounting of the valve housing in its receptacle would be prevented.

The method according to the invention for producing a hydraulic directional valve according to the invention comprises at least the following method steps:

insertion of the filter element into the groove, and formation of at least one axial bulge on at least one of the side walls, which at least one axial bulge extends in the direction of the frame element and acts on the frame element in a positive and/or nonpositive manner.

Here, the bulge can be formed, for example, by means of a calking process, by means of a stamping process or annular stamping process. After the insertion of the filter element into the annular groove, pressure can be exerted on the valve housing, for example the step, for example by means of a calking tool, with the result that the axial bulge is formed and comes into contact with the frame element, buries itself into the frame element or engages into the cutout of the frame element. As an alternative, the radially outer edge of the side wall or of the step can be displaced in the axial direction, for example by means of a stamping process or roll forming process, in such a way that the displaced material (the bulge) presses the frame element against the groove bottom.

Advantageously, first of all the filter element is inserted into the groove and subsequently the bulge is formed.

BRIEF DESCRIPTION OF THE DRAWINGS

Further features of the invention result from the following description and from the drawings, in which exemplary embodiments of the invention are shown in simplified form and in which.

DETAILED DESCRIPTION OF THE INVENTION

Figure 1:
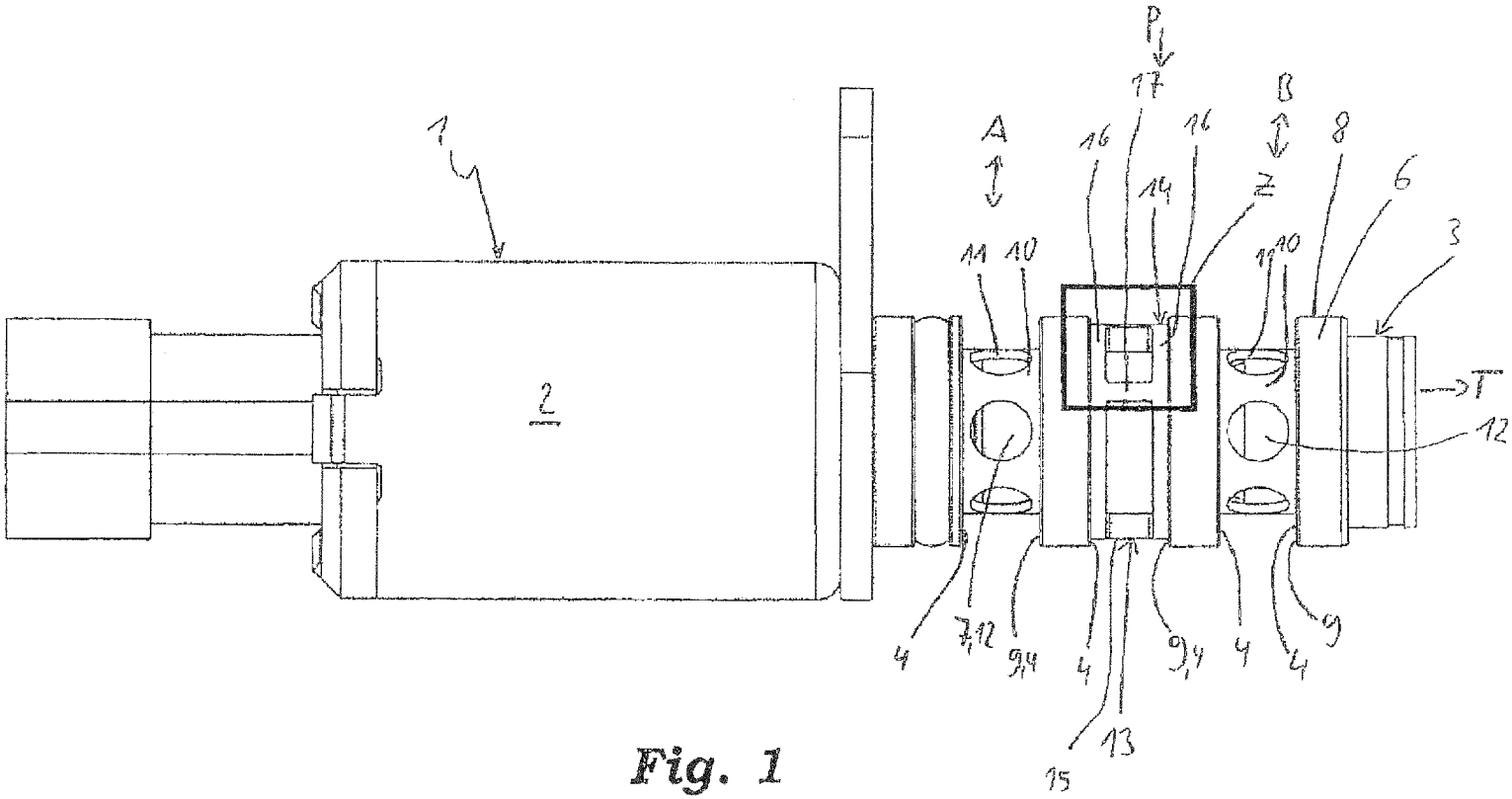
FIG. 1 shows a hydraulic directional valve according to the invention in a plan view.

FIG. 1 shows a hydraulic directional valve 1 according to the invention in a plan view, using the example of a directional valve 1 which is configured as a 4/3-way proportional valve. The directional valve 1 comprises an actuating unit 2 and a valve section 3. Directional valves 1 of this type are used, for example, for controlling hydraulic camshaft adjusters.

The valve section 3 of the directional valve 1 is usually received in a receptacle of a surrounding construction, for example a cylinder head or a cylinder head cover. The valve section 3 has a valve housing 6 of substantially cylindrical configuration and a control piston 7. The valve housing 6 is configured as a separate component and is connected fixedly to the actuating unit 2.

A plurality of grooves 9, annular grooves in the embodiment shown, are formed on the outer circumferential face 8 of the valve housing 6, which grooves 9 are configured to be open radially to the outside. The grooves 9 are delimited radially to the inside by in each case one groove bottom 10 which is shaped like a cylinder shell and in the axial direction by an annular side wall 4. The grooves 9 communicate via openings 11 which are formed in the groove bottoms 10 with the interior of the valve housing 6 of substantially hollow cylindrical configuration. The openings 11 of the grooves 9 and that opening 11 of the valve housing 6 which faces away from the electromagnetic actuating unit 2 serve as pressure medium connections A, B, P, T. The control piston 7 is arranged axially displaceably within the valve housing 6. Control sections 12 which are configured as annular webs are formed on the outer circumferential face of the control piston 7. The external diameter of the control sections 12 is adapted to the internal diameter of the valve housing 6. Adjacent pressure medium connections A, B, P can be connected to one another by suitable axial positioning of the control piston 7 relative to the valve housing 6. The working connection A, B which is in each case not connected to the feed connection P is connected to the tank connection T at the same time. In this way, pressure medium can be fed to or discharged from the individual pressure chambers of the camshaft adjuster in a targeted manner.

The control piston 7 is loaded at one end with the force of a spring element (not shown) in the direction of the electromagnetic actuating unit 2. A push rod (not shown) which is connected to an armature (not shown) of the actuating unit 2 bears against the other axial end of the control piston 7.

In the currentless state of the actuating unit 2, the control piston 7 is displaced in the direction of the electromagnetic actuating unit 2 on account of the force of the spring element. By current being applied to the actuating unit 2, the control piston 7 is displaced counter to the force of the spring element.

A filter element 13, an annular filter in the embodiment which is shown, is arranged within the central groove 9, which filter element 13 extends along the entire circumference of the groove 9. The filter element 13 has a frame element 14 and a filter fabric 15. The frame element 14 comprises two part elements 16 which extend in the circumferential direction of the valve housing 6 and are connected to one another by means of axially extending transverse struts 17. The filter fabric 15 is arranged between the part elements 16 and the transverse struts 17. In order to keep a disruption of the pressure medium flow through the filter element 15 as low as possible, the transverse struts 17 are advantageously arranged between the openings 11. Pressure medium which is conveyed by the pressure medium pump (not shown) to the central groove 9 passes through the filter fabric 15 to the openings 11 and therefore into the interior of the directional valve 1, foreign bodies which are situated in the pressure medium being kept away from the interior of the directional valve 1.

Figure 2:
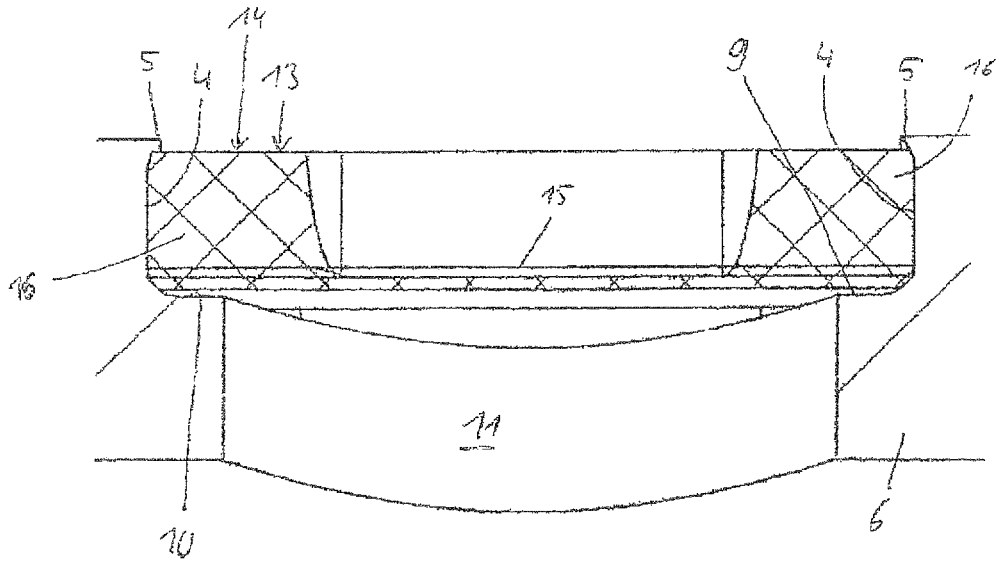
FIG. 2 shows the detail Z from FIG. 1 in longitudinal section.

FIG. 2 shows the detail Z from FIG. 1 in longitudinal section. The frame element 14 is arranged completely within the groove 9 and bears against its side walls 4. In each case one annular bulge 5 which extends in the axial direction is formed at the radially outer end of the side walls 4. Here, the bulge 5 is configured in such a way that it presses the frame element 14 against the groove bottom 10. A nonpositive connection is therefore produced between the groove bottom 10, the frame element 14 and the bulges 5, which connection prevents a movement of the filter element 13 relative to the groove bottom, in particular a rotation of the annular filter. The bulge 5 can bear, for example, against the circumferential face of the frame element 14 (FIG. 2, left hand side) or act on the corner of the frame element (FIG. 2, right hand side). In addition, cutouts can be provided at the corners of the frame element 14, into which cutouts the bulges 5 engage, as a result of which a positive connection in the circumferential direction is produced in addition to the nonpositive connection.

The mounting of the filter element 13 takes place in a plurality of steps. After the production of the valve housing 6, the filter element 13 is positioned in the groove 9. At this point, the side walls 4 do not yet have any bulges 5. The filter element 13 can therefore be inserted into the groove 9 without problems. Subsequently, the bulges 5 are produced, for example, by means of an annular stamping process. Embodiments are likewise conceivable, in which only local bulges 5 are formed instead of the annular bulge 5. Said local bulges 5 can be produced, for example, by means of a stamping or calking process.

It is therefore precluded that the filter element 13 rotates relative to the valve housing 6 as a result of the flow forces of the pressure medium in the circumferential direction.

Figure 3:
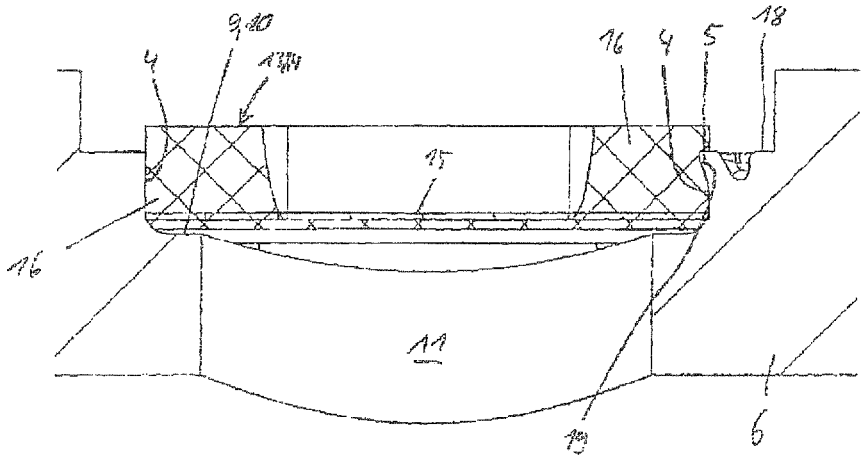
FIG. 3 shows the detail Z from FIG. 1 of a further embodiment according to the invention of a hydraulic directional valve in longitudinal section.

FIG. 3 shows an alternative embodiment of a hydraulic directional valve 1 in the illustration of FIG. 2. In this embodiment, the side walls 4 are of stepped configuration in the radial direction. The groove 9 therefore has a radially outer section with a greater axial extent and a radially inner section with a smaller axial extent. The regions are connected via a step 18. In the embodiment which is shown, the step 18 is of straight configuration and is arranged at right angles to the sections of the side walls 4, other embodiments also being conceivable. The filter element 13 is positioned in the radially inner section of the groove 9, the frame element 14 bearing against the inner sections of the side walls 4 and protruding beyond the step 18 in the radial direction. Below the step 18, the radially inner section of the side wall 4 has a bulge 5 which extends in the axial direction. The bulge 5 engages into a depression 19, for example a cutout which is formed on the frame element 14, on an axial side face of the left hand part element 16 of the frame element 14. There is therefore a positive connection between the side wall 4 and the filter element 13, which positive connection prevents a rotation of the filter element 13 in the groove 9. In addition, the bulge 5 can be configured in such a way that it bears nonpositively against the frame element 14 in the cutout, as a result of which greater forces can be absorbed in the circumferential direction. Embodiments are likewise conceivable, in which no depressions 19 are provided on the frame element 14, but rather the bulges 5 bear only nonpositively against an axial side face of the part element or part elements 16.

The mounting of the filter element 13 takes place in a plurality of steps. After the production of the valve housing 6, the filter element 13 is positioned in the groove 9 in the radially inner section. At this point, the side walls 4 do not yet have any bulges 5. The filter element 13 can therefore be inserted into the groove 9 without problems. Subsequently, the bulges 5 are produced, for example, by means of a calking process. Here, a ram is pressed onto the step 18, as a result of which material of the side wall 4 is displaced in the axial direction, as a result of which the bulge 5 is formed. In addition to the embodiment, in which the frame element is provided with cutouts, embodiments are also conceivable, in which the frame element 14 does not have any cutout before the formation of the bulge 5, but rather the displaced material which will form the bulge 5 buries itself into the frame element 14 during the calking operation. In this case, there is automatically an additional nonpositive connection between the side wall 4 and the frame element 14. Since the frame element 14 protrudes beyond the step 18 in the radial direction, it is ensured that the bulge 5 acts on the frame element 14. Furthermore, it is prevented that material of the step 18 which is displaced in the radial direction during the calking operation protrudes beyond the groove 9 and therefore would make the insertion of the valve housing 6 into the receptacle of the surrounding construction difficult or impossible.

In both embodiments, as an alternative or in addition, filter elements 13 which are fastened by means of bulges 5 can also be provided in the outer grooves 9 which serve as working connections A, B. The bulges can be formed on one or both side walls 4.

LIST OF DESIGNATIONS

1 Directional Valve
2 Actuating Unit
3 Valve Section
4 Side Wall
5 Bulge
6 Valve Housing
7 Control Piston
8 Outer Circumferential Face
9 Groove
10 Groove Bottom
11 Opening
12 Control Section
13 Filter Element
14 Frame Element
15 Filter Fabric
16 Part Elements
17 Transverse Strut
18 Step
19 Depression
P Feed Connection
T Tank Connection
A First Working Connection
B Second Working Connection

The invention claimed is:

1. A hydraulic directional valve, comprising:

a valve housing having a substantially hollow cylindrical configuration and at least one groove, which encircles the valve housing in a circumferential direction, the groove has a groove bottom and two side walls that extend substantially in the circumferential direction and a radial direction; and a filter element arranged in the groove and having at least one frame element and a filter fabric, which is connected fixedly to the frame element, wherein at least one of the side walls has at least one axial bulge which extends axially with respect to the substantially hollow cylindrical configuration in a direction of the other of the side walls and acts on the frame element in a positive and/or nonpositive manner.

2. The hydraulic directional valve as claimed in claim 1, wherein the frame element has an axial side face and the bulge bears nonpositively against the axial side face of the frame element.

3. The hydraulic directional valve as claimed in claim 2, wherein the frame element protrudes beyond the groove in the radial direction.

4. The hydraulic directional valve as claimed in claim 1, wherein the frame has a radially outer face and the bulge is arranged at least partially radially outside the frame element and bears nonpositively against the radially outer face of the frame element.

5. The hydraulic directional valve as claimed in claim 1, wherein the frame element has a depression and the bulge engages into the depression of the frame element.

6. The hydraulic directional valve as claimed in claim 1, wherein at least the side wall is of stepped configuration and the frame element and the bulge being arranged radially within the step.

7. A method for producing a hydraulic directional valve comprising a valve housing having a substantially hollow cylindrical configuration and at least one groove, which extends in a circumferential direction around the valve housing, the groove has a groove bottom and two side walls that extend substantially in the circumferential direction and a radial direction; and a filter element arranged in the groove and having at least one frame element and a filter fabric, which is connected fixedly to the frame element, wherein at least one of the side walls has at least one axial bulge which extends axially with respect to the substantially hollow cylindrical configuration in a direction of the other of the side was and acts on the frame element in a positive and/or nonpositive manner, the method comprising the following steps:

inserting the filter element into the groove; and forming the axial bulge on the side walls.

8. The method as claimed in claim 7, wherein the bulge is formed by a calking process.

9. The method as claimed in claim 7, wherein the bulge is formed by a stamping process or an annular stamping process.

10. The method as claimed in claim 7, wherein the filter element is first inserted into the groove and subsequently the bulge is formed.

* * * * *